US006431538B1

(12) United States Patent
La Vos et al.

(10) Patent No.: US 6,431,538 B1
(45) Date of Patent: Aug. 13, 2002

(54) APPARATUS FOR REMOVING SHEETS, ONE-BY-ONE, FROM THE TOP OF A STACK OF SHEETS

(75) Inventors: Peter George La Vos, Baarlo; Petrus Johannes Maria Thissen, Helden, both of (NL)

(73) Assignee: Oce-Technologies B.V. (NL)

( * ) Notice: Subject to any disclaimer, the term of this patent is extended or adjusted under 35 U.S.C. 154(b) by 112 days.

(21) Appl. No.: 09/678,087

(22) Filed: Oct. 4, 2000

(30) Foreign Application Priority Data

Oct. 5, 1999 (NL) ..... 1013218

(51) Int. Cl.[7] ..... B65H 3/14
(52) U.S. Cl. ..... 271/98; 221/94; 221/104
(58) Field of Search ..... 271/94, 97, 98, 271/104

(56) References Cited

U.S. PATENT DOCUMENTS

| | | | | | |
|---|---|---|---|---|---|
| 3,796,455 | A | * | 3/1974 | Linkbom | 271/97 |
| 4,369,960 | A | * | 1/1983 | Brisebarre | 271/20 |
| 4,787,618 | A | | 11/1988 | Martin | |
| 5,110,110 | A | * | 5/1992 | Wirz et al. | 239/587.1 |
| 5,181,706 | A | | 1/1993 | Yamamoto et al. | |
| 5,328,165 | A | | 7/1994 | Martin | |
| 5,988,626 | A | * | 11/1999 | La Vos et al. | 271/106 |
| 6,074,163 | A | * | 6/2000 | Yamazaki et al. | 271/97 |
| 2001/0020959 | A1 | * | 9/2001 | Van Soest et al. | 347/8 |

FOREIGN PATENT DOCUMENTS

| | | | | |
|---|---|---|---|---|
| EP | 0223502 A2 | | 5/1986 | |
| EP | 0361259 A1 | | 4/1990 | |
| EP | 0801016 A1 | | 10/1997 | |
| JP | 6-227692 | * | 8/1994 | B65H/3/48 |

* cited by examiner

*Primary Examiner*—David H. Bollinger
*Assistant Examiner*—Kenneth W Bower
(74) *Attorney, Agent, or Firm*—Birch, Stewart, Kolasch & Birch, LLP

(57) ABSTRACT

An apparatus for removing sheets, one-by-one, from the top of a stack utilizing a suction conveyor means disposed above the stack and provided with side-blowing means having first blowing nozzles which blow a first air flow directly against the side of the top sheets and a second blowing nozzle which blow an obliquely, upwardly directed air flow against the side of a sheet attracted by the suction conveyor means in order to shake loose sheets sticking to the attracted sheet. Front-blowing means is also utilized to blow air between the sheet to be removed by the suction conveyor means and the rest of the stack in order to press any following sheets firmly to the rest of the stack.

13 Claims, 7 Drawing Sheets

APPARATUS FOR REMOVING SHEETS, ONE-BY-ONE, FROM THE TOP OF A STACK OF SHEETS

BACKGROUND OF THE INVENTION

The present invention relates to an apparatus for removing sheets, one-by-one, in a removal direction from the top of a stack of sheets, which comprises a support for the stack of sheets, removal means disposed a short distance above the stack for attracting and removing, in the removal direction, the top sheet of a stack of sheets lying on the support, and side-blowing means for blowing air, looking in the removal direction of the sheets, from the side in the direction of the stack.

An apparatus of this kind is known from U.S. Pat. No. 4,787,618. This patent describes an apparatus wherein the removal means comprise a suction means against which the top sheet of the stack is firmly sucked so as to be removed on transport by said suction means, and wherein in addition a side-blowing means introduces air into the stack of sheets in the event of sheets sticking to one another and in the event the top sheet is not brought into contact with the suction means at the correct time.

The range of sheets used as receiving material in the current generation of printing machines is considerable and it is expected that it will increase even more in future. In these conditions, a reliable supply of this broad range of receiving materials, varying from thin to thick receiving material and from smooth to stiff receiving material, is subject to increasingly stringent requirements. Especially in the case of fast productive printing machines, it is desirable to minimise feed faults, particularly the feed of double sheets or the failure of sheet feed, in order that the time elapsing between two feed faults in high-speed machines can be made acceptably short. One and the same malfunction frequency (number of faults per total number of feed cycles) will occur, for example, just once a day in the case of a slow and less productive printing machine, but, for example, once per hour in the case of a high-speed productive printing machine, the latter being unacceptable.

In order to obtain good separation between just the top sheet of a stack and the rest of the stack it is known, from European Patent Application 0 223 502, to direct a number of differently directed air jets onto the front of the stack of sheets in a direction which is opposed to the direction in which the sheets are removed from the stack one-by-one. These air jets serve to blow the top sheets of the stack loose from one another and move them upwards in the direction of a suction conveyor belt disposed above the stack and in order to create a positive pressure in the area between the top sheet sucked against the suction conveyor belt and the rest of the stack to ensure that on the removal of the top sheet by the suction conveyor belt the following sheets of the stack are retained by pressing them down.

One disadvantage of this latter known apparatus is that, necessarily, the transport path provided at the front of the stack for the removal of the top sheet, as considered in height, limits the space for providing the blowing means. The blowing means must in fact be disposed at an ample distance beneath the suction conveyor belt to offer sufficient free access between the belt and the blowing means for the undisturbed removal of sheets from the stack. This limits the freedom for achieving optimal blowing geometry.

SUMMARY OF THE INVENTION

An object of the present invention is to provide an apparatus which solves the above disadvantages.

To this end, according to the present invention, the side-blowing means generates at least two differently directed air flows, a first air flow substantially parallel to the plane in which the sheets are lying and at least directed on the top sheets of the stack and the space thereabove, and a second air flow which, with respect to the first air flow, is directed obliquely upwards in the direction of a sheet attracted by the removal means. As a result, when the top sheets of the stack which have been blown loose and brought up by the first air flow have come into the range of the suction conveyor belt, the sheet situated beneath the top sheet attracted by the suction conveyor belt is effectively loosened from said top sheet because of the creation of a flat air stream beneath the attracted sheet which, comparable to the fluttering of a flag in the wind, shakes any attached sheet loose. Another effect is that the blowing means can occupy a fixed orientation with respect to the stack, by accommodating them in a slidable side guide, so that the operation is independent of the sheet format.

Preferably, front-blowing means are provided to blow air in a direction opposed to the removal direction between a sheet attracted by the removal means and the rest of the stack. As a result, air can readily be blown into the space beneath the top sheet as created by the side-blowing means, so that sheets situated beneath the top sheet can be pressed down in order to retain the same on removal of the top sheet.

The side-blowing means can also generate at least a third air flow, directed on sheets situated beneath the top sheets of the stack. The effect of this is that sheets which cannot easily be blown loose and lifted by the first air flow, for example because they are too heavy and/or curved with the convex side lying at the top on the support, are brought within range of the first air flow and the attracting action of the removal means.

BRIEF DESCRIPTION OF THE DRAWINGS

The present invention will hereinafter be explained with reference to the accompanying drawings wherein.

DETAILED DESCRIPTION OF THE INENTION

Figure 1:
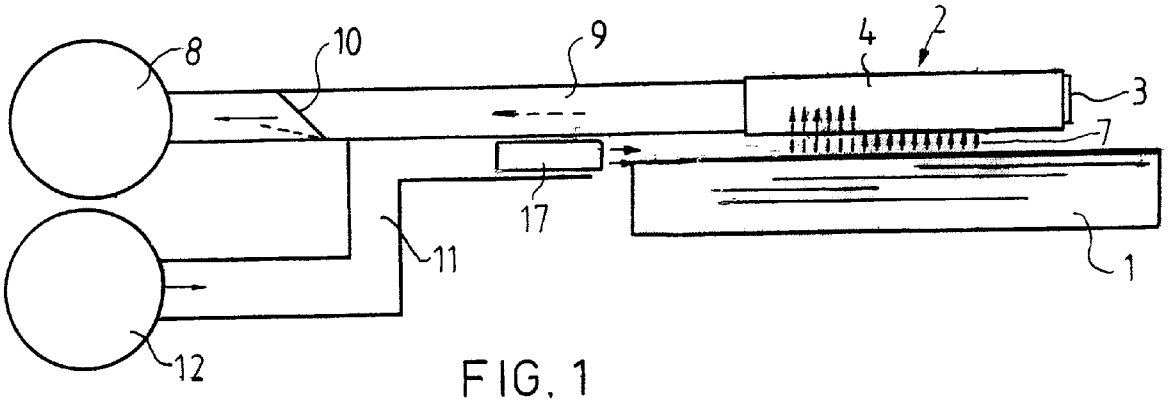
FIG. 1 is a diagram of an apparatus in which the present invention can be applied.

The apparatus shown in FIG. 1 for loosening and removing the top sheet from a stack of sheets 1 is adapted to feed receiving sheets, one-by-one, from a supply container to a printing apparatus (not shown) in which said receiving sheets can be printed. The apparatus shows a suction belt conveyor 2 disposed above the stack of sheets 1 which includes a fixed suction box 3 with an endless conveyor belt 4 trained therearound. The bottom of the suction box 3 and the conveyor belt 4 are both provided with holes. Air passages are created at places where the holes come to be opposite one another, so that an upwardly directed force can be obtained as shown by arrows 7 in FIG. 1. This upwardly directed force 7 is generated by means of a fan 8 connected via a suction line 9 to the suction box 3. With the fan 8 in rotation, the upwardly directed force 7 is brought about to suck the top sheet of the stack 1 against the suction belt conveyor 4 by activating a magnetic valve 10 in the suction line 9. The magnetic valve is adapted to be operated by a control system (not shown). The sheet released from the stack and attracted by suction is then removed from the stack 1 by the driven conveyor belt 4. On transfer of said sheet to a transport nip (not shown) in the removal path the drive for the endless conveyor belt 4 is stopped and the vacuum in the suction box 3 is switched off.

A delivery line 11 is connected to the delivery side of the fan 12 and discharges at one side of the stack of sheets 1. If the top sheet of the stack has still not been sucked against the suction belt conveyor, the fan 12 blows air into the delivery line 11. This air flows out in the direction of the side of the stack of sheets 1 to blow the top sheets loose and push the top sheet up in the direction of the suction belt conveyor 2 as will be described in greater detail hereinafter with reference to FIGS. 3–5. During the blowing loose of the top sheets from one side of the stack the incoming air forms a nucleus for blowing air between the sheets for the purpose of separating the same.

A fan 13 also feeds air via a line 14 to a blowing nozzle 15 from which the air is blown against the front of the top sheets released from the stack. This air flow 16 blown against the front of the stack thus serves to support the loosening of only the top sheet of the stack by creating a positive pressure between the top sheet and the rest of the stack, such positive pressure pressing firmly on the stack those sheets which are situated beneath the top sheet in order to prevent their removal.

Figure 2:
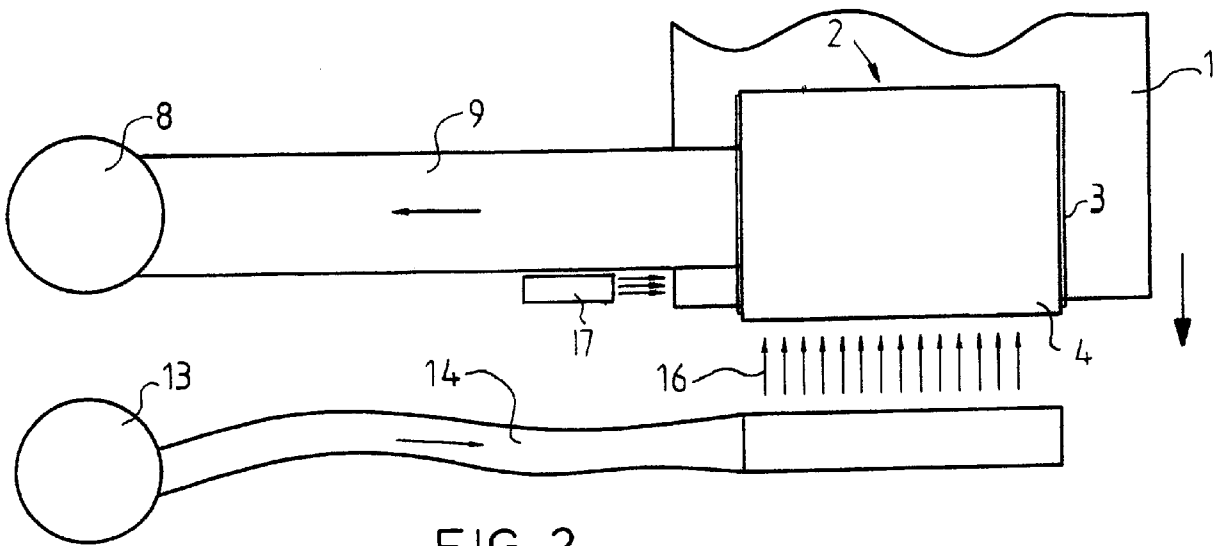
FIG. 2 is a top view of the apparatus shown in FIG. 1.
Figure 5B:
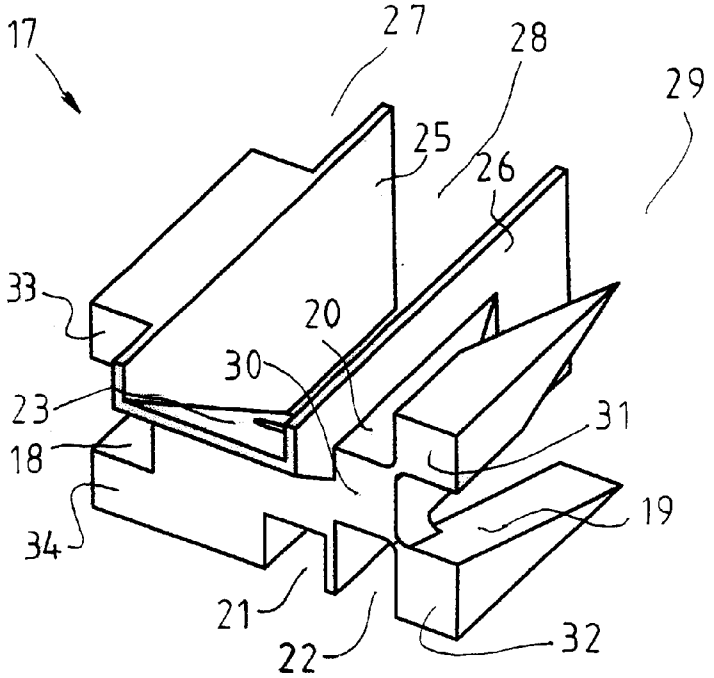
FIGS. 5A and 5B are different views, in perspective, of an insert suitable for generating the different air flows by side-blowing means.
Figure 5A:
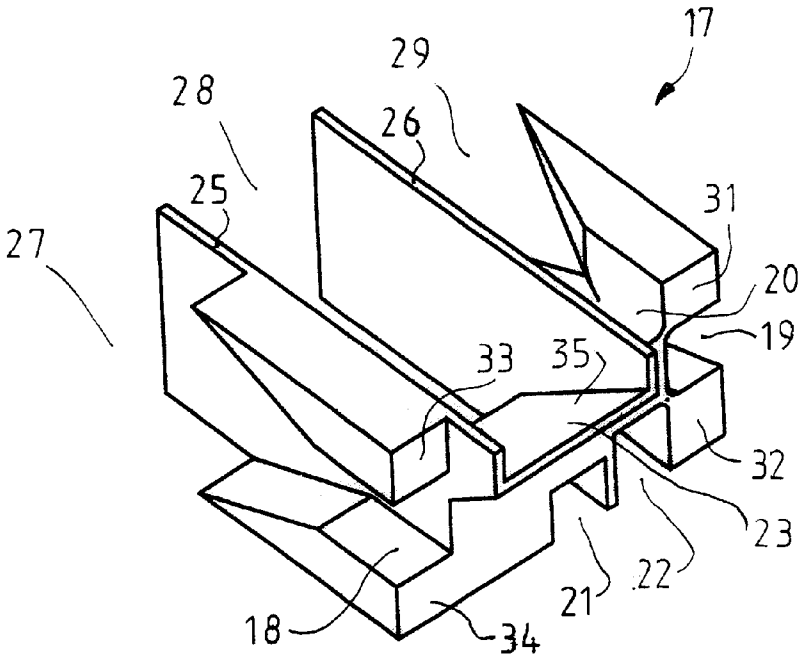

An insert 17 shown in detail in FIGS. 5A and 5B in the opening of the delivery line 11 ensures that the side-blowing air is divided up into a number of different air flows, each having its own specific function to enable the top sheet to be properly separated from a stack of sheets. The insert 17 acts as a nozzle in the form of a spout mounted slidably in the opening of the delivery line 11 in order that the insert 17 for separating sheets of different formats, e.g. varying between A5 and A3, can be placed at substantially equal distances from the side of the stack. The air flowing out of the delivery line 11 has a high speed, e.g. an exit speed of as much as 22 to 28 m/s. The blowing nozzles formed by the insert 17 comprise:

- two blowing nozzles 18 and 19 disposed next to one another in spaced relationship to blow the top sheets loose from the stack 1. For this purpose the nozzles 18 and 19 are situated with their bottom half opposite the top sheets of the stack and with their top half above the stack as shown in FIG. 2.
- A blowing nozzle 20 disposed at a higher level than the blowing nozzles 18 and 19 to feed the top sheet blown loose by blowing nozzles 18 and 19 into the range of the suction conveyor belt 4.
- Two blowing nozzles 21 and 22 disposed at a lower level than blowing nozzles 18 and 19 for lifting relatively heavy sheets, and
- An obliquely upwardly directed blowing nozzle 23 to blow loose one or more sheets which may stick to the top sheet adhering to the suction conveyor belt 4.

As shown in greater detail in FIGS. 5A and 5B, the exit openings 18 to 23 inclusive are formed in the rectangular cross-section of the insert. To this end, the insert 17 contains two vertical partitions 25 and 26 which, when looking from the sheet removal side, are disposed at a distance of ⅓ and ⅚ parts of the width of the insert, respectively. The partitions form three compartments 27, 28 and 29 having a size of ⅓, ½ and ⅚ of the cross-section of the delivery line 11.

At mid-height, compartment 29 at the half adjoining partition 26 is provided with a block 30 having a height of ⅓ of the partition in order to form thereabove an outflow opening 20 and therebeneath an outflow opening 22. In the other half of compartment 29, blocks 31 and 32 are disposed at top and bottom, respectively, each having a height 15 of ⅓ of the partition height in order to form outflow opening 19.

Block 30 has an oblique side extending from an edge forming the outflow opening 19 to the partition 26; block 32 has an oblique top extending from the bottom edge of outflow opening 19 to the bottom wall of the insert 17 and block 31 has a bottom and side. each forming a continuous transition from the outside of the insert 17 and respectively the top edge of outflow opening 31 and the side edge of outflow opening 20.

At the top and bottom the compartment 27 is provided with blocks 33 and 34, respectively, each having a height of ⅓ of the partition height, to form outflow opening 18. A plate 35 is disposed between the partitions 25 and 26 at an angle of about 40° to the longitudinal direction of the insert. Plate 35 extends to outside the outflow plane of the openings 18 and 22 and forms a wide outflow opening 23 at the top of the insert 17 with a height of about ⅕ of the height of the insert 17. Beneath the oblique plate 35 a block 36 seals off the insert 17 leaving a square outflow opening 21 situated next to outflow opening 22 and of a somewhat smaller height.

Figure 3:
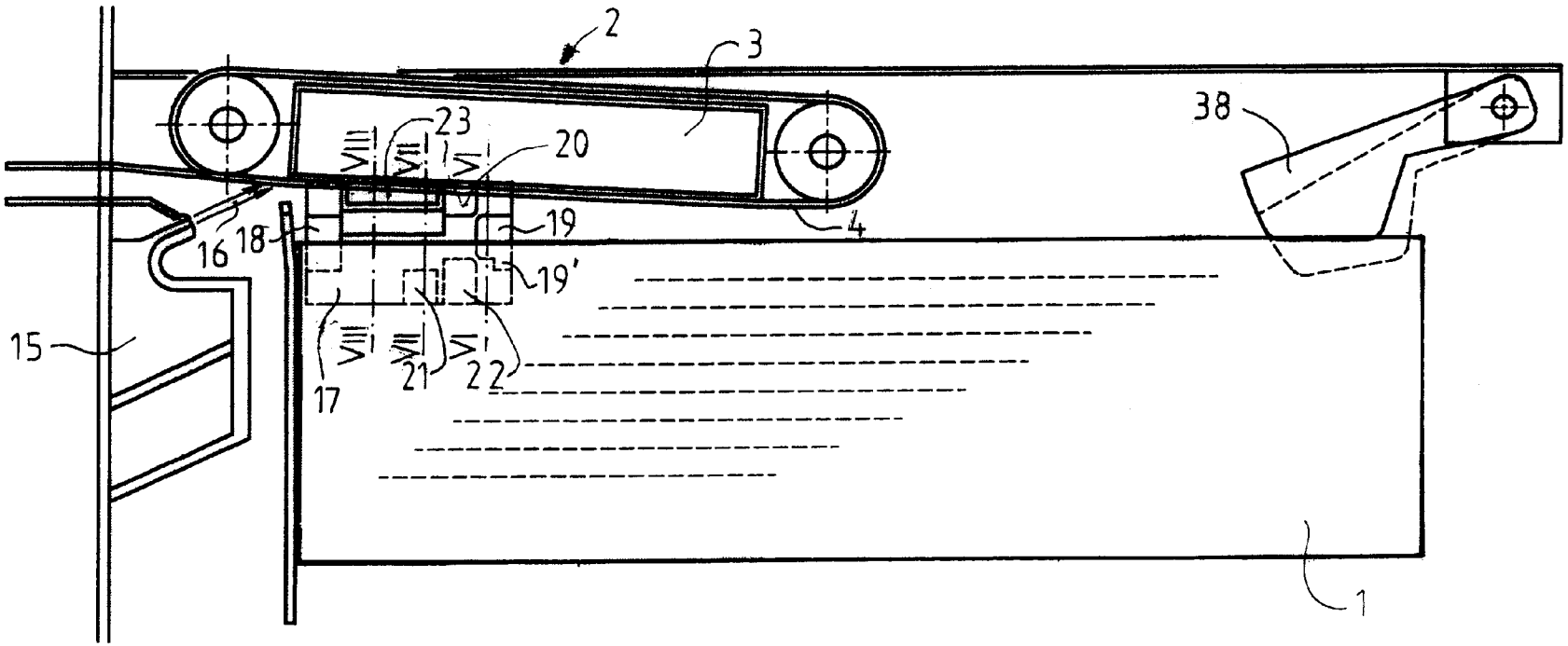
FIG. 3 is a side elevation of an apparatus according to the present invention showing the placing of the air separating means with respect to a stack of sheets.
Figure 4:
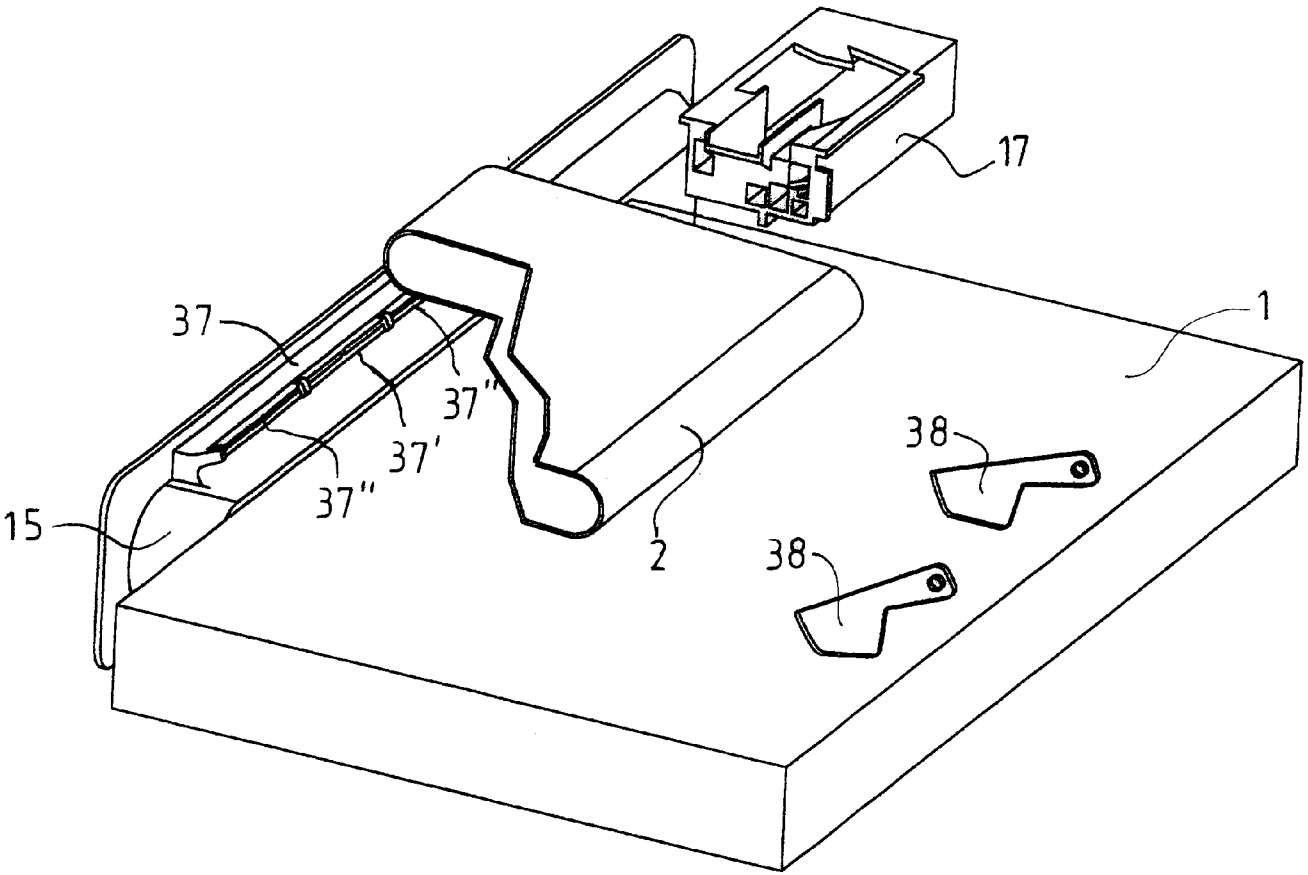
FIG. 4 is a top view of the apparatus shown in FIG. 3.

FIGS. 3 and 4 show the blowing nozzle 15 which blows an air flow 16 against the front of sheets released from the stack in order to bring air between the sheet sucked against the suction conveyor belt 4 and a sheet therebeneath, in order to press the latter sheet on the stack. The air flow 16 is directed in the form of a knife over an area situated just in front of the front edge of a sheet sucked against the suction conveyor belt 4 and is embodied by a slot-shaped blowing spout 37 which, in a central part 37', is wider than at parts 37" situated adjacent thereto, in order to give a greater air flow in the central part than at the sides, and in order to obtain a good build-up of air pressure beneath the top sheet. This build-up is further enhanced by the suction conveyor belt 4 diverging in the sheet removal direction with respect to the stack of sheets and by two contact-pressure elements 38 resting on the back of the stack, the elements 38, looking in the sheet removal direction, maintain the sides of the top sheet down in order to prevent air from escaping from the blowing spout at the sides of the stack before sufficient air pressure has built up beneath the top sheet.

Figure 6:
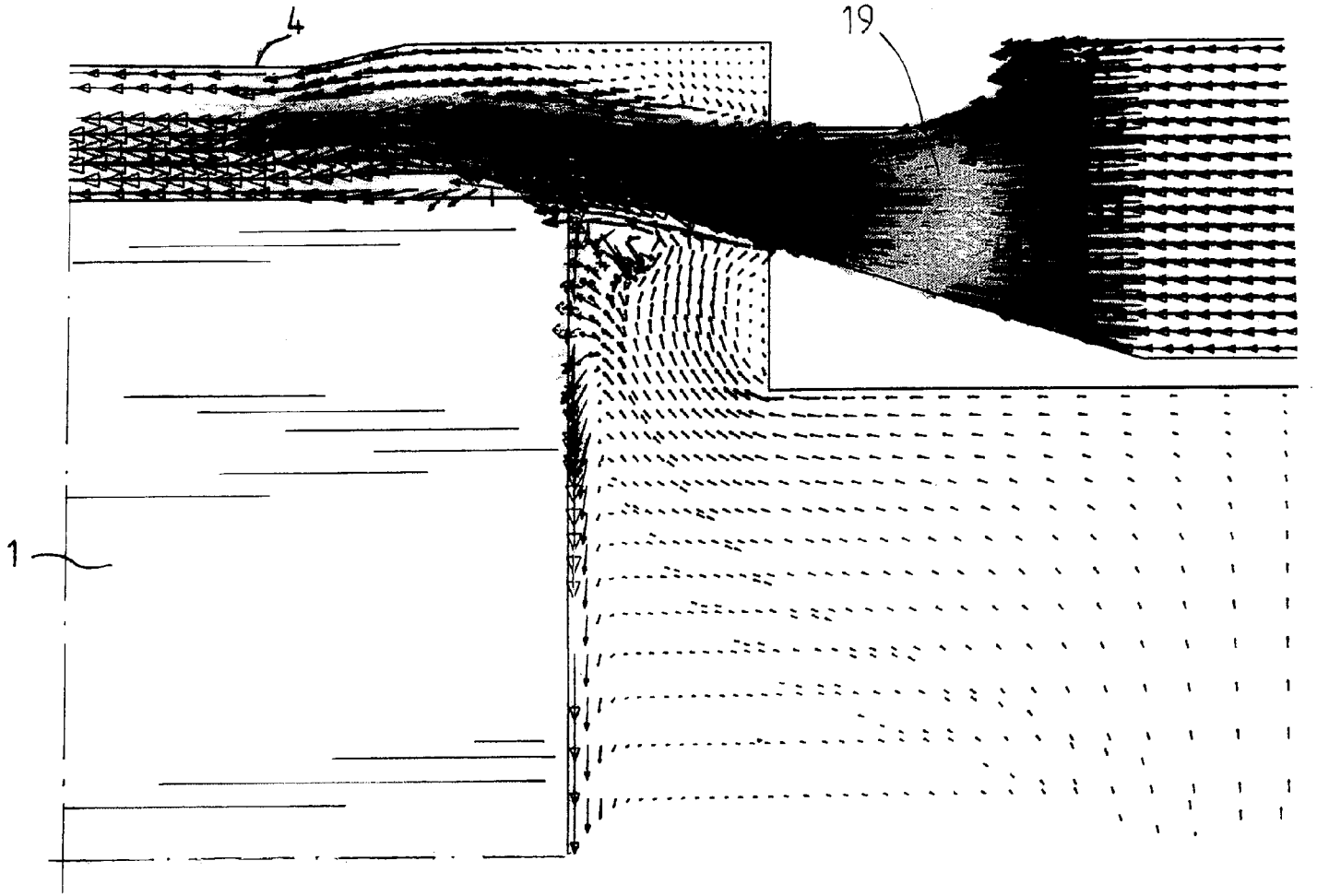
FIGS. 6, 7 and 8 are diagrams showing the respective air flows generated by the side-blowing means in the cross-sectional planes VI—VI, VII—VII and VIII—VIII shown in FIG. 3.
Figure 7:
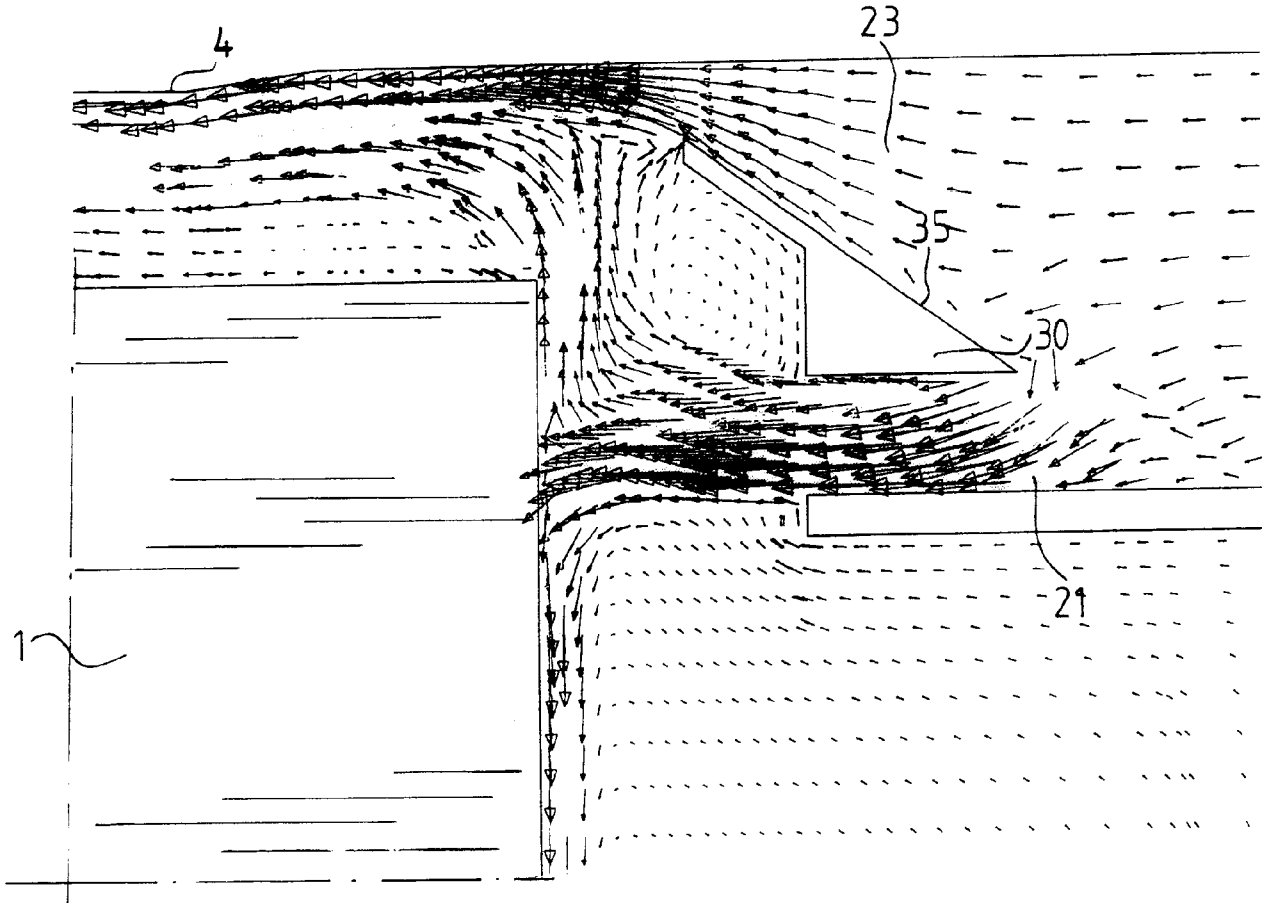
Figure 8:
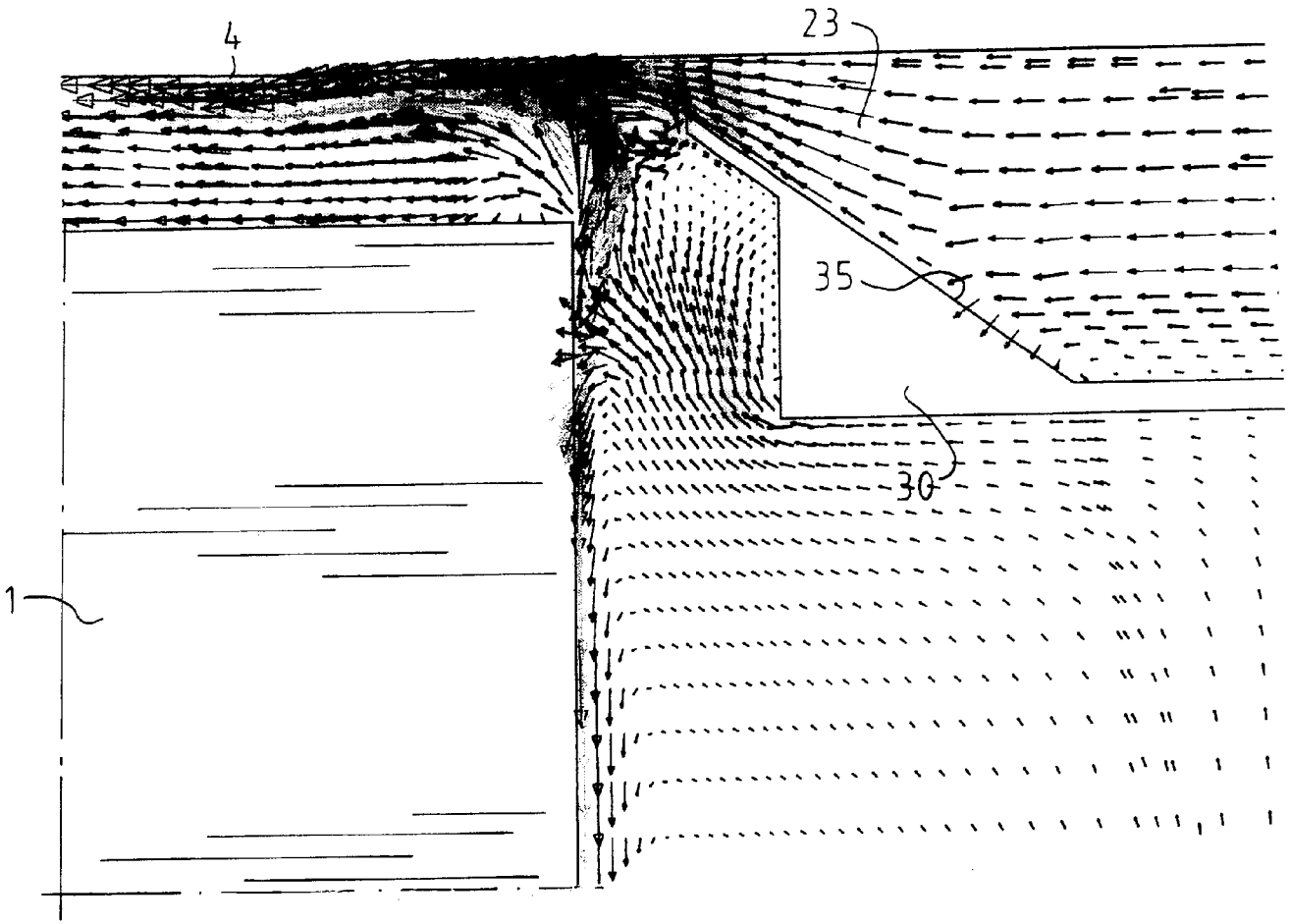

The operation of the apparatus described above for separating sheets, and particularly the operation of the side-blowing means, is explained further hereinafter with reference to FIGS. 6–8, which show the air flow from the side-blowing means in different cross-sections. According to an air flow model, the air speed in FIGS. 6–8 is shown at different places, higher air speeds being indicated by larger arrow heads. In areas with a considerable flow at high speeds, the large arrow heads close together give a greater blackening than in areas having a low flow at low speed, as will be particularly apparent from FIG. 6.

At the start of a separating cycle, the sheets forming a stack are situated tightly on one another. Because of the resistance that the incoming air experiences between the sheets, in this starting situation it is practically impossible to suck up a sheet simply by activating the suction action of the suction conveyor means above the stack. On an upward movement of the sheets there is, in fact, a vacuum forming between the sheets and this vacuum increases with increasing upward speed of the sheets. By blowing air between the sheets this vacuum force is eliminated. This blowing loose starts before the suction effect of the suction conveyor means is activated and is achieved particularly by air flow from the side-blowing nozzles 18 and 19. The powerful somewhat upwardly directed air flow from nozzle 19 shown in FIG. 6 ensures that sheets which in the first instance have been blown loose by nozzle 18 which blows directly against the top sheets of the stack, are conveyed further upwards. The air flow from blowing nozzle 20 feeds upwardly moved sheets further upwards as far as the suction belt conveyor 2 which sucks up the top sheet. As soon as the blowing loose or upward feeding stops, the stack collapses back. Just before that happens the suction action of the suction conveyor belt 4 which is still stationary is activated to prevent the top sheet from collapsing back with the stack.

As already stated, the blowing up, particularly of heavy sheets and/or sheets which are lying curved in the stack with their convex side above, is promoted by blowing air from blowing nozzles 21 and 22 against the stack. This horizontally directed air flow is well visible in FIG. 7. At the bottom, blowing nozzle 19 is provided with a lowered part 19' as shown in FIG. 3, which ensures that when the top sheet is situated at the transition between blowing nozzles 22 and 19, said sheet rises satisfactorily.

The flat airstream directed obliquely upwards from blowing nozzle 23 is directed at the side of a sheet sucked against the suction belt 4, as shown particularly in FIG. 8 and also in FIG. 7. By the generation of this powerful air flow, which particularly sweeps along the bottom of the sheet sucked into contact, the top sheets flutter in a manner comparable to a flag fluttering in the wind. The instability occurring in sheets along which air flows is known as the Kelvin-Helmholtz effect. Any sheets that might still be sticking to one another are separated as a result of this effect during the last part where sheets are lifted from the stack to the suction belt. Smooth sheets particularly in a damp environment are sensitive to sticking together. In order to hold the top sheet against the suction belt conveyor within the range of the side-blowing means, the suction nozzle has, on one side projecting outside the suction belt, contact-suction openings to prevent the top sheet from hanging down in the range of operation of the side-blowing means.

The top air flow shown in FIGS. 7 and 8 is also intended to prevent sheets from being pressed against one another against the underside of the suction box as a result of the bottom air flow shown in FIG. 7. An air flow of uniform air velocity is formed as a result of the considerable restriction of the outflow opening and the shape of the inflow duct.

A condition for sheets being properly blown loose is that the side edges of the sheets which are required to be blown loose should be situated straight above one another. This is achieved by holding against a stop, the top sheets of the stack on the side opposite the side-blowing means, such stop preventing a sheet from being blown away, sideways.

Simultaneously with the activation of the suction effect of the suction belt conveyor 2, the air flow 16 from front-blowing means 15 is activated in order to blow air between the top sheet sucked against the suction belt 4 and the rest of the stack in order to form a positive air pressure into the space formed by the side-blowing means, namely the air flow from side-blowing nozzle 23, to press the stack down.

When this force for pressing the stack down has been built up sufficiently, with the assistance of the contact pressure means 38 sealing off the excess pressure space at the sides, the suction conveyor belt 4 is started in order to remove the sheet sucked into contact therewith, the air pressure that has built up beneath said sheet pressing the rest of the stack down in order to prevent following sheets from being simultaneously entrained with the sheet being removed.

The above-described apparatus can advantageously be used in the apparatus described in Applicants' European Patent Application 0 801 016, the side-blowing means indicated therein being constructed as described above.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for removing sheets, one-by-one, in a removal direction from the top of a stack of sheets, comprising a support for the stack of sheets, removal means disposed a short distance above the stack for attracting and removing, in the removal direction, the top sheet of a stack of sheets lying on the support, and side-blowing means for blowing air, at the edge of the sheets, perpendicular to removal of the sheets from the stack in the direction of, wherein the side-blowing means can generate at least two differently directed air flows, a first air flow substantially parallel to the plane in which the sheets are lying and at least directed on the top sheets of the stack and the space thereabove, and a second air flow which, with respect to the first air flow, is directed obliquely upwards in the direction of a sheet attracted by the removal means.

2. The apparatus according to claim 1, wherein the front-blowing means are provided for blowing air in a direction opposed to the removal direction between a sheet attracted by the removal means and the rest of the stack.

3. The apparatus according to claim 1, wherein the side-blowing means generate at least a third air flow directed at sheets situated beneath the top sheets of the stack.

4. The apparatus according to claim 1, wherein the side-blowing means, looking in the removal direction, are situated at a short distance from the removal side of the stack of sheets.

5. The apparatus according to claim 1, wherein the removal means comprises a suction conveyor means and in that control means are provided with stop the action of the side-blowing means shortly after the operation of the suction conveyor means has started.

6. The apparatus according to claim 5, wherein the control means start the operation of the front-blowing means substantially simultaneously with the operation of the removal means.

7. The apparatus according to claim 1, wherein the side-blowing means generating the first air flow comprise at least two spaced apart first blowing nozzles, each of which lie partially beneath the top of the stack of sheets and partially above the top of the stack of sheets.

8. The apparatus according to claim 7, wherein the side-blowing means generating the first air flow comprises a second blowing nozzle which is situated above one of the first blowing nozzles.

9. The apparatus according to claim 8, wherein the side-blowing means generating the second air flow comprises a third blowing nozzle which is situated at the level of the bottom of the removal means disposed at some distance above the stack of sheets.

10. The apparatus according to claim 9, wherein the third blowing nozzle has a bottom surface which forms an acute angle with the support for the stack of sheets in order to produce an air flow from the third blowing nozzle which sweeps closely along the bottom of the removal means.

11. The apparatus according to claim 10, wherein the third blowing nozzle has an outflow opening, the width of which is at least twice as large as its height.

12. The apparatus according to claim 9, wherein the third blowing nozzle, looking in the horizontal direction, is situated between the first two blowing nozzles.

13. A method for removing sheets, one-by-one, from the top of a stack of sheets which comprises applying a suction to the top of the stack of sheets, blowing a first air flow directly against the side of the top sheets, blowing a second air flow obliquely upwardly against the side of the sheet attracted by the suction in order to shake loose sheets sticking to the attracted sheets, and blowing air from the front between the sheets to be removed by the suction and the rest of the stack in order to press any following sheets firmly to the rest of the stack.

* * * * *